US009999288B2

(12) United States Patent
Samain

(10) Patent No.: US 9,999,288 B2
(45) **Date of Patent: *Jun. 19, 2018**

(54) COSMETIC OR DERMATOLOGICAL SYSTEM WITH AUTOMATIC ADJUSTMENT OF THE PROPERTIES OF A PREPARATION AS A FUNCTION OF DATA TRANSMITTED BY A TRANSMITTER EXTERNAL TO THE SYSTEM

(75) Inventor: Henri Samain, Bievres (FR)

(73) Assignee: L'OREAL, Paris (FR)

( * ) Notice: Subject to any disclaimer, the term of this patent is extended or adjusted under 35 U.S.C. 154(b) by 300 days.

This patent is subject to a terminal disclaimer.

(21) Appl. No.: 13/119,065

(22) PCT Filed: Oct. 23, 2009

(86) PCT No.: PCT/IB2009/054700

§ 371 (c)(1),
(2), (4) Date: Jun. 23, 2011

(87) PCT Pub. No.: WO2010/046884

PCT Pub. Date: Apr. 29, 2010

(65) Prior Publication Data

US 2011/0247718 A1 Oct. 13, 2011

Related U.S. Application Data

(60) Provisional application No. 61/111,439, filed on Nov. 5, 2008.

(30) Foreign Application Priority Data

Oct. 23, 2008 (FR) ..... 08 57204

(51) Int. Cl.

| | |
|---|---|
| ***A45D 44/00*** | (2006.01) |
| ***B01F 13/10*** | (2006.01) |
| ***B01F 15/00*** | (2006.01) |

(52) U.S. Cl.

CPC ..... *A45D 44/005* (2013.01); *B01F 13/1055* (2013.01); *B01F 13/1063* (2013.01); *B01F 15/00305* (2013.01); *A45D 2200/058* (2013.01)

(58) Field of Classification Search

None

See application file for complete search history.

(56) References Cited

U.S. PATENT DOCUMENTS

| | | | |
|---|---|---|---|
| 3,934,596 | A | 1/1976 | Suntheimer et al. |
| 4,962,910 | A | 10/1990 | Shimizu |
| 5,746,348 | A | 5/1998 | Bloom |
| 5,785,960 | A | 7/1998 | Rigg et al. |
| 5,848,732 | A | 12/1998 | Brugger |
| 6,371,451 | B1 | 4/2002 | Choi |
| 6,595,389 | B2 | 7/2003 | Fuchs |
| 6,769,580 | B2 | 8/2004 | Muderlak et al. |
| 6,986,442 | B2 | 1/2006 | Engel et al. |
| 7,247,140 | B2 | 7/2007 | Ophardt |
| 7,850,051 | B2 | 12/2010 | Py et al. |
| 2003/0064350 | A1 | 4/2003 | Rubinstenn et al. |
| 2003/0069667 | A1 | 4/2003 | Dirksing et al. |
| 2004/0133306 | A1 | 7/2004 | Schmid |
| 2004/0188469 | A1 | 9/2004 | Lambrakis et al. |
| 2005/0005678 | A1 | 1/2005 | Duranton |
| 2006/0108247 | A1 | 5/2006 | Liechty et al. |
| 2006/0258946 | A1 | 11/2006 | Hayano et al. |
| 2008/0047972 | A1 | 2/2008 | Bartholomew et al. |

FOREIGN PATENT DOCUMENTS

| | | | |
|---|---|---|---|
| DE | 100 16 078 | A1 | 5/2001 |
| DE | 20 200 40 11 856 | U1 | 12/2004 |
| EP | 2 081 668 | A | 7/2009 |
| FR | 2 807 346 | | 10/2001 |
| WO | WO 98/30189 | A | 7/1998 |
| WO | WO 02/094423 | A1 | 11/2002 |
| WO | WO 2006/044585 | A2 | 4/2006 |
| WO | WO 2008/046518 | A1 | 4/2008 |
| WO | 2010/004528 | A1 | 1/2010 |

OTHER PUBLICATIONS

French Republic Preliminary Report for National Register No. FA 715504 FR 0857203 dated Aug. 6, 2009.

French Republic Written Opinion for National Register No. FR 0857203 dated Aug. 6, 2009.

International Search Report for International Application No. PCT/IB2009/054701 dated Feb. 4, 2010.

Written Opinion for International Application No. PCT/IB2009/054701 dated Feb. 4, 2010.

International Search Report for International Application No. PCT/IB2009/054700 dated Feb. 4, 2010.

Written Opinion for International Application No. PCT/IB2009/054700 dated Feb. 4, 2010.

Republic of France Search Report for National Registration No. FA 715505 FR 0857204 dated Jul. 20, 2009.

French Republic Written Opinion for National Register No. FR 0857204 dated Jul. 20, 2009.

International Search Report for International Application No. PCT/IB2009/054699 dated Feb. 12, 2010.

Written Opinion for International Application No. PCT/IB2009/054699 dated Feb. 12, 2010.

(Continued)

*Primary Examiner* — Jessica Worsham

(74) *Attorney, Agent, or Firm* — Oliff PLC

(57) ABSTRACT

A cosmetic or dermatological system includes a receiver of data related to current and/or future surrounding conditions transmitted by a data transmitter external to the system, a packaging and dispenser device containing one or more compositions from which a preparation is delivered, an adjustment system that is coupled to or suitable for coupling to the packaging and dispenser device, and that enables at least one characteristic of the dispensed preparation to be varied, and a processor for automatically controlling the adjustment system as a function of the received data or for informing the user, as a function of the received data, about an action to be exerted on the adjustment system.

21 Claims, 6 Drawing Sheets

(56) References Cited

OTHER PUBLICATIONS

Republic of France Search Report for National Registration No. FA 715207 FR 0857200 dated Jul. 20, 2009.
French Republic Written Opinion for National Register No. FR 0857200 dated Jul. 20, 2009.
U.S. Appl. No. 13/119,065, filed Mar. 15, 2011.
U.S. Appl. No. 13/119,073, filed Mar. 15, 2011.
Jul. 29, 2013 Office Action issued in U.S. Appl. No. 13/119,073.
Mar. 2, 2017 Office Action issued in European Patent Application No. 09 744 477.2.

COSMETIC OR DERMATOLOGICAL SYSTEM WITH AUTOMATIC ADJUSTMENT OF THE PROPERTIES OF A PREPARATION AS A FUNCTION OF DATA TRANSMITTED BY A TRANSMITTER EXTERNAL TO THE SYSTEM

TECHNICAL FIELD

The present disclosure relates to dispensing a cosmetic or dermatological preparation, and more particularly but not exclusively, to dispensing of sun exposure related products.

BACKGROUND

Cosmetics are often made available in numerous variants to enable adaptation to various situations.

Thus, sun exposure products, e.g., sunscreens, can be provided in several levels of potency (e.g., varying SPFs), containing varying quantities of active agents, for example, filters, to enable adaption to differing sunlight conditions.

Users of such products can be faced with issues of selection when deciding what product to acquire and/or use for any particular set of sunlight conditions (e.g., intensity, directness, exposure times, etc.) This can lead to hesitation in selecting one level or potency over another, because the user may know in advance that sunlight conditions will vary. The user may choose to acquire several different products of different potencies, but such a solution may not be desirable, at least because of the space occupied by such the products and their expense.

Another choice may be to use the product having the highest potency, but such a solution may not be desirable because using maximum protection when conditions do not call for such protection presents several drawbacks. For example, all or portions of the sunlight spectrum are substantially prevented from reaching the skin, so it may not tan, thereby not developing physiological transformations that would provide it with its own protection (e.g., melanin production.)

One potential solution could be to take advice from a specialist prior to exposure to sunlight during a particular time, or to take measurements from an appliance configured to measure light flux. Such solutions may not be desirable because the specialist or the appliance may have limited availability, and may not provide advice day after day. Furthermore, additional attention may be exercised by a user when transforming the advice received into a selection of a product having the desired potency. For example, conversion tables may be provided, thereby making such selections unattractive and prone to error.

Issues relating to selecting products having different potencies also present themselves when conditions change, as for example, with products that provide protection against drying, high temperature, or low temperature.

Furthermore, for various reasons, numerous care products may be available in only one or several potencies, for example, as a result of manufacturing and/or economic considerations. Although manufacturers may desire to make a wide variety of products available to satisfy the needs of many users, they may determine, e.g., based on economic reasons, to restrict themselves to a smaller number of available products.

It is known that ultraviolet (UV) filters can be effective in protecting the color of the hair, particularly when used in suitable quantities and concentrations. Such concentrations can give create a rather "heavy" feel, i.e., an undesirable feeling for the user following application of the product. It is thus undesirable to use high concentrations if the amount of sunlight does not warrant use of such concentrations.

Users may also choose to use products with more moderate concentrations of protective active agents, e.g., to limit the undesirable "heavy" feeling following application. However, such concentrations may provide undesirably low levels of protection to higher levels of sunlight, thereby potentially resulting in damage, possibly irreversible, to the coloring and state of the hair.

It is also known that hair is sensitive to the electrical conductivity of the air. If the air has very low electrical conductivity, for example, in dry air, then the hair may become charged with static electricity, making brushing or combing the hair difficult or even impossible. Product manufacturers have been hesitant to create products to combat static electricity because, with regard to the hair, the phenomenon is rather rare. Further, while it may be possible to incorporate active agents in conventional products such as, for example, shampoos, to combat the effect of static electricity, such agents again can result in an undesirable "heavy" feel. Therefore, it may be undesirable to provide such agents to the hair when the ambient conditions are not such that the presence of such agents is desirable.

Issues related to selecting levels of potency for a product may be more difficult where ambient conditions vary in unforeseen ways over time. For example, while it is sometimes possible to predict how the level of sunlight is going to vary, it is more difficult to predict how temperature, humidity, or wind speeds may vary over time.

Thus, selecting a product may be a complicated exercise and may result in errors. This may be particularly true when precipitation or sudden changes in temperature or humidity occur during the course of a particular time period. Such variations may harm the quality of products that have been applied and may reduce their effects, particularly because it is not uncommon for a user to be taken by surprise by such changes and thus to have incorrect and/or undesirable levels of protection and/or cosmetic effect. For example, a person with a sophisticated hairdo (e.g., voluminous) may desire such a hairdo to maintain its shape, and may therefore apply a large amount of hair spray. However, large amounts of hair spray can result in poor or less than desirable visible appearance and feel. Moreover, such an application may prove undesirable if the weather remains dry and settled.

U.S. Patent Publication No. 2003/0064350 describes a method in which information is obtained concerning a person, e.g. data concerning age, skin type, or hair type, and provides advice about the use of products as a function of the person's location.

U.S. Pat. No. 4,962,910 describes a device including an UV radiation sensor and calculation means that act as a function of skin type and the sunscreen product used to trigger an alarm when the received dose of UV may cause erythemia.

U.S. Patent Publication No. 2005/0005678 describes a packaging and dispenser device including a processor capable of receiving a weather forecast in order to take said forecast into consideration when recommending action to be taken by the user. That application also describes a hygrometer configured to display a recommendation concerning the frequency with which a substance should be applied or the desire to change the nature of the substance used. The processor may receive information delivered by a humidity sensor, and also, where desired, from other sensors, e.g. a sensor configured for contact with the skin, a temperature sensor, or a solar radiation sensor.

Packaging and dispenser devices are also known that may enable the sunscreen index in the delivered preparation to be adjusted manually, by means of a slider provided on the stopper.

U.S. Patent Publication No. 2006/0108247 A1 discloses a packaging and dispenser device enabling the relative proportions of two substances to be varied manually as a function of the properties desired for the preparation.

U.S. Pat. No. 7,247,140 describes a dispenser provided with a UV radiation sensor and means for indicating that the received UV level is above a predefined threshold.

Application DE 20 200 40 11 856 discloses a packaging and dispenser device having two or more cartridges containing different compositions and means for mixing the compositions. The device also includes adjustment means that may enable the mixing of the compositions to be controlled as a function of information provided by a sensor that is for application to a region to be treated, e.g. for the purpose of determining moisture content.

U.S. 2006/0258946 A1 describes a container provided with a device such as a skin moisture sensor or various other sensors.

SUMMARY

There exists a desire to develop a cosmetic and/or dermatological system which addresses some or all of the drawbacks of existing systems.

Some embodiments provide, a cosmetic or dermatological system comprising:

- a receiver of data transmitted by a data transmitter external to the system;
- a packaging and dispenser device containing one or more compositions from which a preparation is delivered;
- an adjustment system that is coupled to or suitable for coupling to the packaging and dispenser device, and that enables at least one characteristic of the dispensed preparation to be varied; and
- means for acting automatically on the adjustment system as a function of data received by the receiver or for informing the user, as a function of said data, about an action to be exerted on the adjustment system.

According to various embodiments, the preparation is delivered in non-gaseous form, for example, in fluid form such as a liquid, cream, gel, suspension, emulsion, or flowable powder.

The packaging and dispenser device and/or the system may be handheld and portable. In other words, the system and/or the packaging and dispenser device may be handled, i.e., may be held in one hand and actuated by one hand.

The received data may be associated with conditions of surroundings, that may be selected from humidity, light (incorporating all or part of the visible spectrum, ultraviolet B (UVB), ultraviolet A (UVA), infrared (IR)), temperature, the electrical conductivity of the air, the magnetic and electric field, pressure, wind, precipitation, fog, ionization, electromagnetic radiation (x-rays, gamma rays, ionizing radiation), the presence of liquid or solid particles, the transparency of the air, the presence of a gaseous chemical compound ($CO_2$, CO, $N_2$, $O_2$, $O_3$, $NO_2$, $NO_3$), the presence of a particular atom (sulfur), and the presence of insects, among other things.

The data received by the system may concern present or future (e.g., forecasted) conditions of the surroundings.

Utilizing systems and methods of the present disclosure, it may be possible to improve and/or optimize the formulation of a preparation that is dispensed in an automatic or semiautomatic manner. The term "automatic" should be understood as meaning that the adjustment of the formulation of the preparation is performed without any substantial user interaction on an adjustment member. The term "semiautomatic" should be understood as meaning that an adjustment is performed with at least some user interaction on the part of the user, e.g., the user may acting manually on the adjustment member to press an adjustment button, slide a slider, turn an adjustment knob. Such semiautomatic adjustments may be performed as a function of information provided by the system, e.g., in audible manner and/or visual manner. Such indications may be provided by, for example, headphones, a loudspeaker, an indicator light, a display, and/or a screen that may be incorporated in the system, e.g., incorporated in the packaging and dispenser device, among others.

When the packaging and dispenser device is used, the preparation that is produced and brought to its outlet presents a concentration of primary and/or secondary active agents that is configured and/or optimized based on data available at the moment of use and/or for forthcoming moments.

The term "primary active agent" should be understood to mean any active agent conferring its main effectiveness on the preparation, e.g., a wetting agent for a shampoo, and the term "secondary active agent" should be understood as an active agent that plays a role in making the preparation desirable for use, such as, for example, with a shampoo, agents providing fragrance and/or controlling rheology.

Where desired, the system may also receive data related to the surroundings from at least one sensor incorporated in the system. For example, such a sensor may be incorporated in the portable packaging and dispenser device and may include, e.g., sensors for solar radiation (e.g., a UV sensor), temperature, humidity, and/or pressure, among others. One of skill in the art will recognize that such sensors may be present in other portions of the system without departing from the scope of the present disclosure.

Adjustments may be performed as a function of received data and of data delivered by the sensor of the surroundings. Where desired, the adjustment may be performed on the basis of data delivered by the sensor of the surroundings, e.g., when no data has been received by the data receiver.

Adjustment may also be performed as a function of data delivered by an internal clock. One of ordinary skill in the art will understand that the internal clock referred to here can differ from a binary clock (i.e., a clock pulse generator) associated with a digital processor. For example, the described internal clock may be provided as hardware and/or software, and be configured to track year, month, day, hour, minute, seconds, and/or season (i.e., winter, spring, summer, and fall), and may be based on, for example, Greenwich Mean Time (GMT) or any other suitable time base.

The system may also receive data from one or more optional sensors for sensing the state or characteristics of a person, e.g., the state of the skin. Such skin sensors may include, for example, a moisture sensor (e.g. of the capacitive type), a color sensor (e.g., for sensing the color or the paleness of the skin), and/or a reader for reading a medium that has previously been applied to the skin (e.g., in order to collect sebum therefrom).

The system may take into consideration user preferences when determining the formulation of the preparation that is dispensed. For example, the user may inform the system about activities the user is going to perform, skin type, age, geographic location, etc. The system may use this information when determining the active agent content(s) for the dispensed preparation.

The energy for powering the system (e.g., for receiving information and performing adjustments) may be provided by a source of electricity internal to the system (e.g., a battery), by an external source of electricity (e.g., electrical outlet), by ambient light (e.g., using a solar cell), and/or by the user acting on an energy converter/generation system (e.g. a system serving to transform a movement of the device or a pressure exerted by the user on the system into electricity, in particular pressure exerted on the packaging and dispenser device.)

Likewise, the energy for dispensing the preparation and making it uniform where desired, may be provided by the user acting on an energy converter or acting directly, e.g. by acting manually on the device, or it may come from an internal or external source of electricity.

In some exemplary embodiments, systems and methods of the present disclosure may be implemented to prepare and apply sunscreen preparations. In such embodiments, adjustments may be is performed based on, among others, present and/or forecast UV light flux (e.g., sunlight exposure).

In some exemplary embodiments, systems and methods of the present disclosure may be implemented to provide preparations to aid in moisturizing the skin and slow or prevent the skin from drying out. In such embodiments, adjustments may be performed based on, for example, present and forecast temperature, humidity, and/or light flux.

In some exemplary embodiments, systems and methods of the present disclosure may be implemented to provide preparations configured to protect against wintry weather (e.g., cold winds, low humidity, inclement weather, low sunlight, etc). In such embodiments, adjustments may be performed based on, for example, present and forecast temperature, humidity, and/or light flux.

Exemplary embodiments of the present disclosure may be helpful for adjusting a primary or secondary active agent within, for example, an antiperspirant, a deodorant, and/or a fragrance. For example, the content of an active agent such as an aluminum salt, an antibacterial agent, and/or a fragrance may be adjusted depending on various factors, e.g., outdoor conditions. The information on the basis of which such adjustments may then be performed based on, for example, present or forecast temperature, humidity, and light flux.

Products for providing protection against mosquitoes are often made available in a single strength only. The content of anti-mosquito active agent (e.g., N,N-diethyl-meta-toluamide (DEET)). Such adjustments may be performed on the basis of information about the surroundings, such as, for example, temperature, humidity, and in addition, information related to present or forecast arrivals or hatchings of broods of insects.

Products for washing the body and the hair are likewise often available in only one strength. The concentrations of active agents, e.g. a wetting agent, depending on outside conditions. For example present or forecast temperature or humidity.

Using systems and methods of the present disclosure, washing preparations, care preparations, makeup, and/or hair-shaping preparations also may be improved, particularly by modifying the content of at least one secondary active agent. For example, through use of information concerning temperature or humidity, a strength of a fragrance may be adjusted. Preparations for the hair, e.g., for washing, for care purposes, and for shaping the hair may also be improved by using information about light levels in order to adjust the level of a sun protection filter.

It is known that filters become effective in protecting color and fibers providing they are used in significant quantity. Such concentrations give rise to a rather heavy feel. Although it is possible to use such concentrations, it is a pity to use high concentrations if there is not very much sunlight. It is thus possible to use preparations with modest concentrations of protective active agents may be prepared using systems and methods of the present disclosure, to limit the undesirability of a heavy feel. However, if there is not sufficient protection, then a high level of sunshine can give rise to irreversible damage to the tinting and the state of the hair. In other words, a hair preparation is made in which the quantity of protective active agents is adjusted automatically or semiautomatically, taking into consideration conditions at the moment of application and/or future conditions.

Some systems according to exemplary embodiments of the disclosure may also be used to incorporate a weighting active agent in the preparation, which is suitable for combating the effects of static electricity on hair, where desired. Such agents may be included based on, for example, information related to present or forecast humidity and/or temperature.

Data received by the system, according to exemplary embodiments of the disclosure, may relate to different points in time, e.g., comprising data in the form of forecasts for the forthcoming hours or days, and where desired associated with probability factors.

Data received by the system, according to exemplary embodiments of the disclosure, may come from international, national, or local weather forecast centers, from meteorological measurement centers, weather beacons, regional weather stations, information centers, e.g. TV, radio, Internet, and individual measurement stations (e.g. including a thermometer, a barometer, and/or an anemometer), among others. Such stations providing data may collect information from any desired locations, e.g., locations that are deemed to be pertinent, particularly for obtaining quality data (e.g., unambiguous information) concerning the conditions of the surroundings. This data may be interpreted by specialists in order to improve forecast quality (e.g., improved reliability).

The received data may be information resulting from a combination of factors. For example, the information delivered to the system may include a risk factor calculated on the basis, for example, of air pollution, e.g. in terms of pollens and/or chemical compounds such as $O_3$, nitrogen oxides, fine particles, etc., and/or temperature, etc., and the system may, as a function of this risk factor, determine the contents of certain agents capable of acting on the sensitization of the skin, e.g. the contents of fragrances, ethanol, and preservatives, among others.

The system may adjust the formulation of the preparation on the basis of the received data, such data enabling the adjustment system to be controlled automatically, or alternatively, the data may be interpreted by a processor means in order to provide data output to a user for semiautomatic controlling of the adjustment system.

The data received by the system according to some exemplary embodiments of the disclosure may relate to conditions of the surroundings expressed in the form of, for example, temperature and/or relative humidity, and may include any other magnitude expressed in a suitable manner, e.g. in SI (System International) units.

The received data may further include data for controlling the adjustment system, such data being obtained by processing information relating to the conditions of the surroundings. For example, the received data may directly control an actuator of the adjustment system, e.g. a motor or a servomotor.

Various techniques may be used for delivering data to the system according to exemplary embodiments of the disclosure. For example, data may be provided by wire, using electric cables or optical fibers, or wirelessly (e.g. by radio frequency, infrared, ultrasound, and in particular by WiFi, Bluetooth™, and VPL, among others).

The system may include display means, e.g., a screen, for displaying information related to the received data, current program(s) (e.g., information related to firmware, software, etc. executed on or capable of execution on the system), and/or one or more characteristics of the dispensed preparation. Where desired, the screen may be tactilely responsive (e.g., a touch screen.)

In some exemplary embodiments of the present disclosure, the system may operate on the basis of only one kind of information about the surroundings, e.g. the intensity of UV radiation. In such embodiments, the adjustment system is suitable for making the adjustment as a function of the received data. The mixing and the delivery of the mixed preparation may take place only if the user has triggered delivery of the preparation. The device may also operate on the basis of two or more kinds of information about the surroundings, for example temperature and pressure, as well as user characteristics, where desired.

In some exemplary embodiments of the disclosure, the received data may not be an empirical sample representative of the conditions of the surroundings, but instead may include information derived from an analysis of the conditions of the surroundings. Thus, for example, an expert system may interpret the information about the surroundings to determine therefrom the amount of precipitation that is to be expected in a future time period, e.g. over the following month. The expert system may then send that information to systems according to exemplary embodiments of the disclosure, to adjust, for example, water content of a tint.

In some embodiments, where the exemplary system does not receive information (e.g., because of a data communication error), the system may inform the user of that situation so as to avoid making the error of producing an unsuitable mixture. The user may then manually select the mixture that is to be prepared or may wait until the system has received the data (e.g., communication restored). In some embodiments, for example, the system may be configured to indicate that the received signals are weak or degraded, and possibly not useful.

The system may also be arranged to take into account data relating to how the system is used, for example the duration of use, the number of uses, the frequency of use. For example, the system may take into account a duration of exposure to the sun in order to modify the content of an active agent, e.g. in order to take account of tanning and the protection that the tanning process provides.

The system may take into account internal information, for example, data related to levels of substances in the reservoirs (e.g., primary and secondary active agents) or flow rate measurements.

The system may constitute an appliance that may be portable and that can be held in the hand. Further, the system may receive directly the information picked up by the receiver, and the receiver may be incorporated in the system.

Where desired, the system may also include a portable packaging and dispenser device in the form of a hand-piece that is associated with a base station. The portable packaging and dispenser device may be arranged to be positioned on the base station when it is not dispensing the preparation.

In some embodiments consistent with the present disclosure, the base station may include a data receiver and at least part of the adjustment system. For example, the base station may include an actuator suitable for acting on an adjustment member of the packaging and dispenser device while the device is in place on the base station. The packaging and dispenser device may include reservoirs containing starting compositions and means for dispensing the preparation. The term "starting composition" shall be understood to mean a composition as originally supplied to a reservoir and configured for inclusion and/or processing into a preparation. Such starting compositions may comprise active agents, neutral agents, and/or any combination thereof as desired. A composition may include a fluid, e.g. liquids, creams, gels, suspensions, emulsions, flowable powder etc., and/or a solid, e.g., a stick, etc. When the user separates the device from the base station, the adjustment may remain as defined by the base station. Where desired, the base station also may act as a docking station for a mobile telephone suitable for receiving external data and controlling the adjustment system.

The system may receive information from an individual terminal or from another system according to exemplary embodiments of the disclosure. The individual terminal may be of any type, e.g. a relay, a mobile telephone, a PDA, a personal computer, a local server, etc.

Exemplary systems may be capable of interpreting forecast information to calculate adjustments that may be desirable. For example, in a system providing sunscreen, the system may receive sunlight data hour by hour, and, in forecast mode, it can determine the total sunlight by calculation and determine therefrom an adjustment to be made.

Under some circumstances, the system may receive, e.g., hour by hour, data about the forthcoming temperature and humidity. The system may rely on the most extreme data (e.g., extrema and/or other interim points) to define a desired level of protection and to determine therefrom the adjustment that is to be made. This may be useful, for example, in an exemplary system for providing protection from drying to the skin, e.g., facial skin.

In some exemplary embodiments, the system may take into account time that is to elapse between making the mixture and the instant when the forecast conditions will occur in the surroundings, to allow for recalculation of the mixture. One of skill in the art will understand that if the time lapse is several hours, it may be desirable for the mixture to be made richer in order to compensate for certain factors, for example, absorption over a length of time.

In some exemplary embodiments, the system, or optionally an individual terminal associated therewith, may display data such as the conditions of the surroundings, the current program, the preparations that have been prepared, e.g. the intended or already-prepared index of protection, and any other information.

The system may be arranged to warn the user of the need to reapply the preparation or to review the mixture, e.g. where the system detects that ambient conditions and/or user preferences have changed.

In some exemplary embodiments, the system may include a memory configured for storing various information, e.g., preparation formulas. The system may be capable of passing into a manual mode, e.g. to reproduce a desired mixture or to reproduce a mixture of a formula that has been stored in the memory.

According to some embodiments, the system may include a packaging and dispenser device having two reservoirs containing first and second starting compositions that are stored separately, the adjustment system being configured to enable these starting compositions to be dispensed in desired proportions as a function of received data. For example, One of the starting compositions may have a concentration of at least one active agent that is different from the concentration in the other starting composition.

Some systems according to exemplary embodiments of the disclosure may include a packaging and dispenser device having two reservoirs containing two starting compositions that are stored separately, the adjustment system being configured to enable one or another of the starting compositions to be dispensed selectively by itself and/or in conjunction with other substances.

The active agent may be selected from sun protection filters, anti-static agents, anti-mosquito agents and/or anti-insect agents (e.g., anti-tick), moisturizers, odorants (e.g., fragrances), deodorants, and antiperspirants.

The received data may include at least information relating to intensity of UV radiation, temperature, humidity, and/or pressure, among others.

According to some exemplary embodiments, the present disclosure may provide a method of preparing a cosmetic or dermatological composition by means of a system as defined above, wherein data suitable for controlling the adjustment system is delivered to the system.

Further exemplary embodiments provide a method of preparing a cosmetic or dermatological composition by means of a system as defined in any preceding claim, wherein data is delivered to a plurality of such systems by at least one distant sender, enabling the adjustment system of each system to be further controlled.

By way of example, the delivered data may come from a home weather station, an individual terminal connected to the Internet, or a remote server, in particular via a connection of the system to the Internet.

In some embodiments, the adjustment system may be controlled as a function of at least information relating to the user to be treated with the preparation, in particular skin type. The adjustment system may also be controlled as a function of data relating to one or more forecast conditions of the surroundings and/or as a function of the time at which the data is received.

The system may be portable and/or hand-held, i.e., may be held in and actuated by one hand.

According to some exemplary embodiments of the present disclosure, a kit is provided. The kit includes a system as defined above; and an individual terminal capable of delivering data to the system, the terminal being arranged to receive the information from a remote server and to process it in order to generate the data that is delivered to the system.

The individual terminal may include a user interface enabling at least one of the following to be input: a characteristic relating to a state of the skin or the hair of the user who is going to receive the dispensed preparation; and information relating to the activity of the person who is going to receive the dispensed preparation.

Where desired, the kit may include a plurality of systems according to exemplary embodiments of the disclosure associated with a common individual terminal, said systems including different starting compositions. The systems associated with a common terminal may be in the form of packaging and dispenser devices each comprising an adjustment system and a data receiver. A network including a common sender (e.g., a server, a broadcaster, etc.) may be configured to transmit substantially the same data to all of the plurality of devices substantially simultaneously and/or successively.

According to some embodiments, a cosmetic or dermatological system may be provided. The system may include a data receiver configured to receive data related to current conditions and/or data indicating future conditions from a source external to the system, a handheld packaging and dispenser device containing one or more compositions and configured to deliver a preparation, an adjustment system that is coupled to or configured for coupling to the packaging and dispenser device, the adjustment system enabling at least one characteristic of the delivered preparation to be varied, and processor means for acting automatically on the adjustment system as a function of data received by the receiver or for informing the user, as a function of said data, about an action to be manually exerted on the adjustment system based on the data.

Aside from the structural arrangements set forth above, the invention could include a number of other arrangements, such as those explained hereinafter. It is to be understood that both the foregoing description and the following description are exemplary.

BRIEF DESCRIPTION OF THE DRAWINGS

The accompanying drawings, which are incorporated in and constitute a part of this specification, illustrate a number of exemplary features of a non-limiting embodiment of the invention and together with the description, serve to explain the principles of the invention. In the drawings.

MORE DETAILED DESCRIPTION

Reference will now be made in detail to exemplary embodiments of the invention, examples of which are illustrated in the accompanying drawings. Wherever possible, the same reference numbers will be used throughout the drawings to refer to the same or like parts. It is to be understood that both the foregoing general description and the following detailed description are exemplary and explanatory only and are not restrictive of the invention, as claimed.

Figure 1:
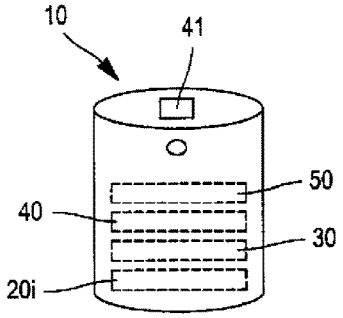
FIG. 1 is a diagram showing an example of a system according to exemplary embodiments of the present disclosure.
Figure 3:
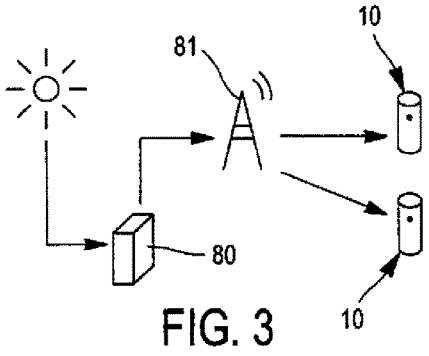
FIGS. 3 to 7 show various ways data may be received by the system according to exemplary embodiments of the disclosure.

FIG. 1 is a diagram of an exemplary system 10 according to embodiments of the present disclosure. System 10 may comprise a single appliance (e.g., packaging and dispenser device) in the form of a handpiece, or it may comprise a plurality of appliances, with a packaging and dispenser device in the form of a handpiece as one element and a base station that is associated with the device as another, for example. In each of the exemplary embodiments described herein, system 10 may include at least one starting composition $\mathbf{20}_i$, an adjustment/dispenser system 30, a user interface 40, and a receiver 50 for receiving external data, however some embodiments may include more or fewer components as desired.

Figure 2:
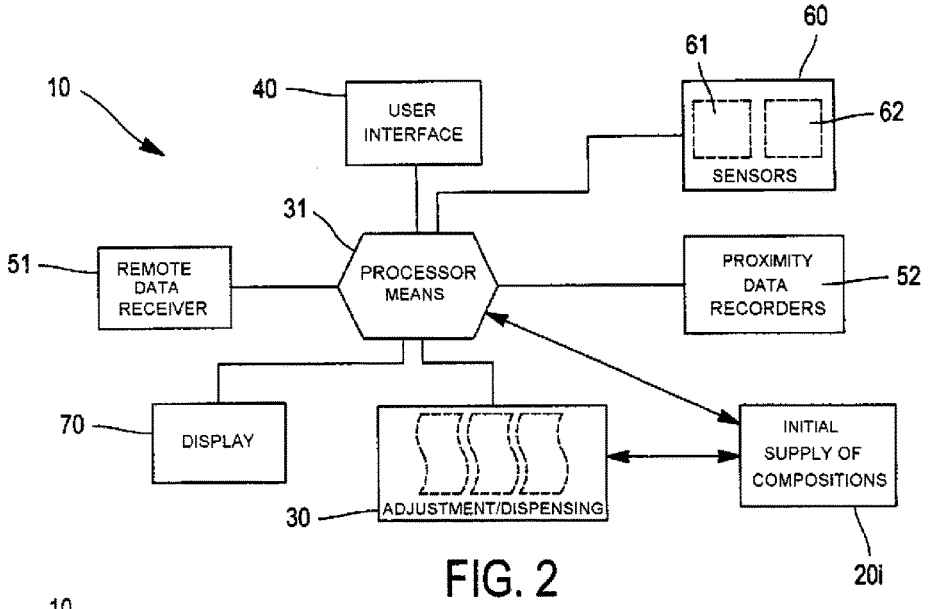
FIG. 2 is a block diagram of various component elements of a cosmetic or dermatological system according to exemplary embodiments of the present disclosure.

As shown in FIG. 2, system 10 may further include processor means 31, e.g. comprising one or more microprocessors and/or microcontrollers and/or an analog electronic circuit, and/or any electronically programmable specialized circuit capable of performing instructions and/or predefined functions. For example, the processor means 31 may comprise a circuit including an i386 architecture processor, a RISC processor, and/or other components configured to cause execution of instructions. These processor means 31 may include an internal pulse generating clock.

The receiver 50 may include at least one of a remote data receiver 51 and a proximity data receiver 52. Further, where desired system 10 may include one or more sensors 60, e.g. surroundings sensors 61 and/or characteristic sensors 62 for measuring characteristic of a region to be treated. System 10 also may include a display means 70, e.g., a screen (not shown in FIG. 1).

User interface 40 may include a button 41 for triggering operation of the system.

Receiver of Remote Data

Remote data receiver 51 may be configured to receive data via a radiofrequency link operating in the various wavelength bands in which wireless data transmission is performed. Remote data receiver 51 may thus receive data from remote server 80 via one or more radio relays 81, e.g. spread over a territory, or other suitable device. For example, remote server 80 may receive meteorological data, among other things, and transmit the meteorological data to a plurality of systems 10. Each system 10 may process the data transmitted by remote server 80 to select those portions of data that relate to a geographical location of respective system 10 and/or the geographical location set by a user of system 10.

Such data may be received wirelessly or by wire, e.g., via an Ethernet cable, e.g. using an RJ45 connector, a parallel port, or an RS232, RS422, RS485, USB, or IEEE1394 serial port, an optical fiber, carrier current transmission, e.g. of the power line carrier (PLC) type, or radio transmission, e.g. WiFi, mobile telephone (GSM), Bluetooth™, infra red (IR), ultrasound, or other suitable technique.

Remote data receiver 51 may include an antenna, a photodetector, an electrical connector, and/or an optical connector, depending on the mode of data transmission that is used.

Receiver of Proximity Data

System 10, according to exemplary embodiments of the disclosure, may also include proximity receiver 52. The term "proximity receiver" should be understood as meaning a radio frequency or infrared interface receiving data from a short-range transmitter, e.g. a remote control or a mobile telephone, or a wire connection to a local area network (LAN), e.g. a link via an Ethernet, WiFi, or line carrier current cable, or a serial or parallel cable link. In some embodiments, proximity receiver 52 may include a receiver of the Bluetooth™ type.

Surrounding Sensors

System 10 may include one or more surroundings sensors 61 configured to read data associated with the ambient conditions surrounding system 10. For example, such sensors may include UV sensors for detecting UV light flux at the location of system 10, conductance sensors for measuring, e.g., conductance of the air, humidity sensors, temperature sensors, etc.

Data from surroundings sensors 61 may be provided to processor means 31 to enable processor means 31 to determine instructions for preparing a preparation from starting compositions $\mathbf{20}_i$. For example, where a UV sensor is present, UV flux data may be used to determine a concentration for various sun filter compositions to arrive a desired protection level for a preparation.

Surrounding sensors 61 may perform alone or in conjunction with one or more other sensors, including characteristic sensors 62, and further in conjunction with data provided remotely. One of ordinary skill in the art will recognize that various configurations for utilizing such data may be implemented without departing from the scope of the present disclosure.

Characteristic Sensors

System 10 may include one or more characteristic sensors 62 configured to read data associated with the user operating system 10. For example, such sensors may include skin type/color sensors for determining a level of color (e.g., a tan) associated with the user, moisture sensors for measuring the level of perspiration currently present on the user, temperature sensors for measuring body temperature, etc.

Data from characteristic sensors 62 may be provided to processor means 31 (e.g., a processor) to enable processor means 31 to determine instructions for preparing a preparation from starting compositions $\mathbf{20}_i$. For example, where a skin color sensor is present, data related to the skin color of the user may be used to determine a concentration for various sun filter compositions to arrive a desired protection level for a preparation. In such an example, a person having a deep tan may require less sun filter protection than someone with fair skin. Data associated with skin color may therefore assist processor means 31 in making an improved preparation for an individual user.

Characteristic sensors 62 may perform alone or in conjunction with one or more other sensors, including surrounding sensors 61, and further in conjunction with data provided remotely. One of ordinary skill in the art will recognize that various configurations for utilizing such data may be implemented without departing from the scope of the present disclosure.

Data Broadcasting

Data delivered to the various systems 10 may be uniform over a territory, thereby leaving system 10 to select data of interest to the user from the broadcast data provided. Therefore, system 10 may be capable of identifying its location, e.g. by means of a GSM chip, a GPS, receiver, or other suitable device, and/or it may receive information concerning its location from the user.

Figure 4:
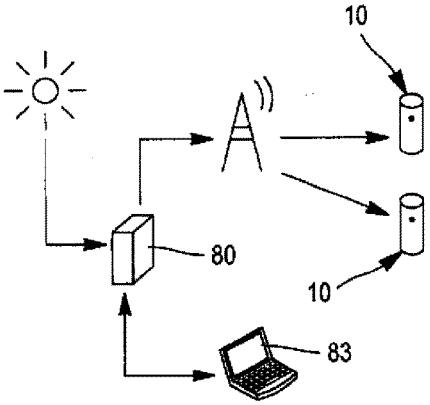

In some embodiments, such as that shown in FIG. 4, data delivered to systems 10 may comprise personalized data, e.g. as a result of an exchange of data between the remote server 80 and a remote terminal 83 e.g. a microcomputer or a mobile terminal. Such an exchange of data may take place, for example, over the Internet and/or by mobile telephony. A user may input data concerning location and/or personal preferences or other data into remote terminal 83, this data being forwarded to the remote server 80 in association with an identifier for the user of the remote terminal 83 (and thereby, system 10), so as to enable system 10 subsequently to recognize the data corresponding thereto. System 10 may send location data automatically to the server 80.

Figure 5:
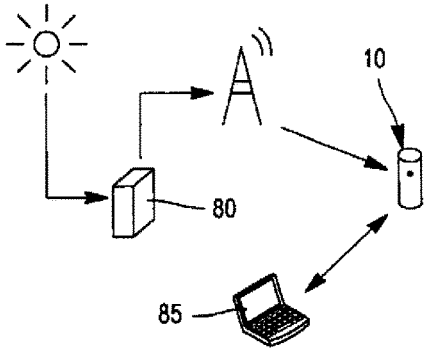

FIG. 5 shows the possibility of system 10 receiving data from the remote server 80 and also from a local terminal 85, e.g. a microcomputer or a mobile terminal, e.g. using proximity receiver 52. A user interface of local terminal 85 may be used to input data into the processor means 31 of system 10, e.g. certain user preferences, and/or to program certain modes of operation.

In some embodiments, system 10 may receive data in passive manner. Alternatively, system 10 may be arranged to interrogate remote server 80 for data, either directly or via a local terminal, e.g. a mobile telephone or an Internet link. Such a request sent to remote server 80 may include, for example, location information and/or information about the user's activity, among other things.

Figure 6:
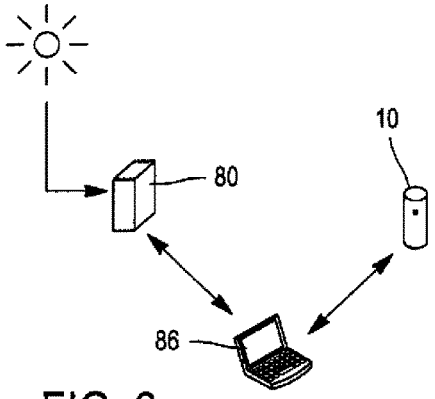

FIG. 6 shows another exemplary embodiment wherein system 10 receives data from the remote server 80 via a local terminal 86, e.g. a microcomputer. The microcomputer may receive data from an network location (e.g., Internet site) connected to remote server 80 and it may forward the data to system 10, in some embodiments, after processing the data.

Figure 7:
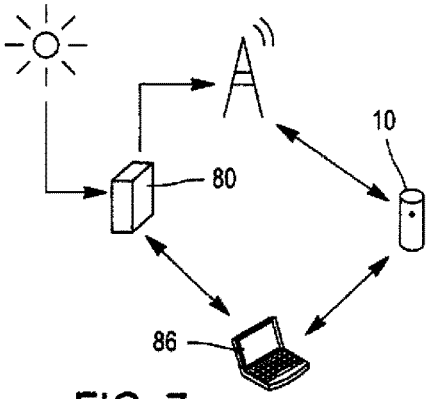

FIG. 7 shows another exemplary embodiment wherein system 10 is configured to receive data both directly from the remote server 80 and from a local terminal 86, e.g. via a mobile telephony data receiver and a Bluetooth™ or WiFi data receiver.

One of ordinary skill in the art will recognize that other configurations of terminals 83 and 86, as well as remote server 80 and system 10 may be implemented without departing from the scope of the present disclosure.

Expert System

Figure 15:
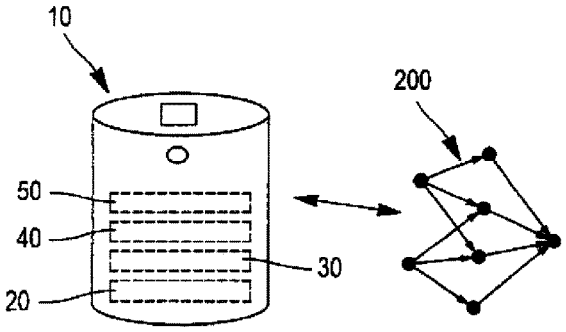
FIG. 15 is a diagram showing an exemplary system in another embodiment of the disclosure.
Figure 23:
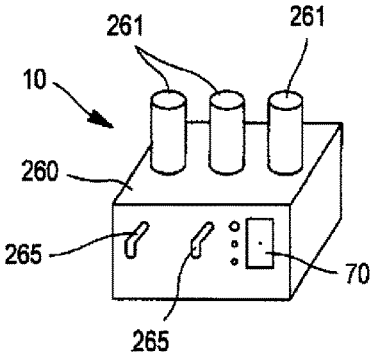
FIGS. 16 to 23 are diagrams showing several alternative embodiments of a system according to exemplary embodiments of the disclosure.

FIG. 15 shows the possibility of system 10 exchanging data with a separate expert system 200. For example, expert system 200 may include a microcomputer with which system 10 is capable of communicating, or expert system 200 may be a server with which system 10 is capable of communicating, e.g. via the Internet. The expert system 200 may also form part of the system according to exemplary embodiments of the disclosure and by way of example it may be situated in a base station not far from system 10, e.g. constituting a stand on which the packaging and dispenser device may be placed after it has been used.

In some embodiments, expert system 200 may contribute to performing calculations needed for determining a concentration of one or more active agents for a desired preparation as a function of certain conditions of the surroundings.

Controlling the Adjustment System

The adjustment system 30 may be controlled directly by the processor means 31, acting to adjust automatically the properties of the preparation that is dispensed.

Figure 8:
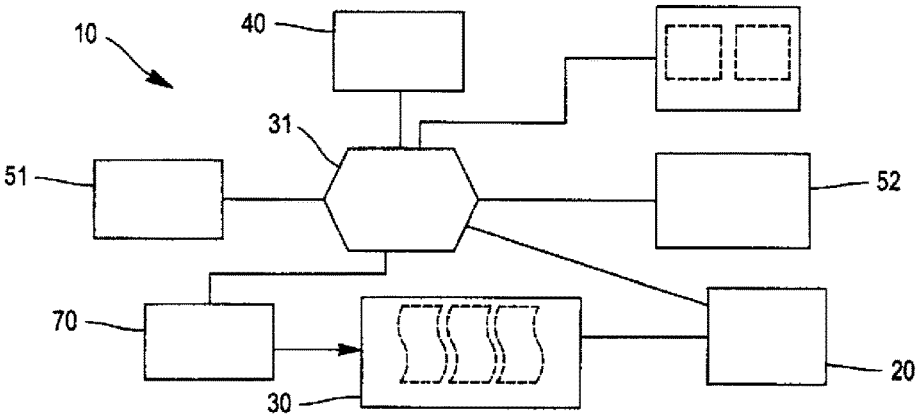
FIG. 8 is a view of an another system to that shown in FIG. 2 and according to embodiments of the present disclosure.

In some embodiments, for example, as shown in FIG. 8, processor means 31 may cause information to be displayed on display means 70, thereby enabling the user to adjust the adjustment system 30 manually so that the preparation that is dispensed presents the desired characteristics. The display means 70 may include a screen 72 suitable for displaying various kinds of information, for example a mode of operation 73 as selected by the user, and in particular an automatic mode or a manual mode. Automatic mode may corresponds to automatically adjusting the properties of the preparation as a function of received data, whereas manual mode may enable the user to cause a preparation to be dispensed that has characteristics that are set by the user.

Figure 9:
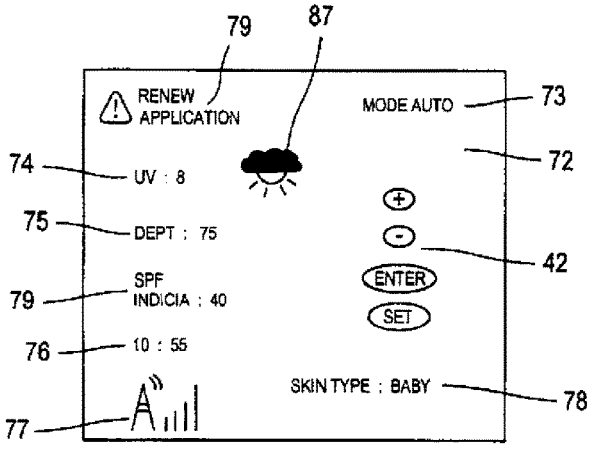
FIG. 9 shows an example of data that may be displayed on the system.

In some embodiments, for example, as shown in FIG. 9, screen 72 may display information 74 relating to local weather data, e.g. a UV index representative of the intensity of UV radiation at ground level, together with a present or future weather forecast. In some embodiments, the display may be embodied in the form of a pictogram 87.

Screen 72 may display information 75 relating to the location of system 10, or it may enable such information to be displayed, e.g. a code for the state or the department in which the user is situated. Screen 72 may also display the time 76, indicate good reception of data by system 10 via an indicator 77, possibly display information related to the user's skin type 78, which is used for performing automatic adjustment, and also an index of protection 79 of the preparation for and/or as dispensed, e.g. the sun protection factor (SPF) index. In some embodiments, calculation of this index may take into account the skin type selected by the user, the time of day, and the received weather data, in particular data relating to sunlight. Where desired, the user interface may include buttons 42 that appear on the screen, e.g., when the screen is a touch screen.

Screen 72 also may display an alarm 79 to warn the user that it is time to renew application of the preparation. Where desired, this alarm may be accompanied by an audible signal (e.g., via a loudspeaker or a headphone set).

Adjustment system 30 may be controlled by system 10, which may incorporate one or more (e.g., all) of the actuators needed for actuating an adjustment member, for example a valve that controls the flow rate of a starting composition $\mathbf{20}_i$.

Adjustment System

System 10 according to exemplary embodiments of the disclosure includes a packaging and dispenser device that contains one or more starting compositions $\mathbf{20}_i$. Embodiments of system 10 may further comprise a variety of adjustment systems 30 and data receivers 50, which may, for example, be located within the same housing as a starting composition $\mathbf{20}_i$.

In a variant, the system comprises a packaging and dispenser device in the form of a handpiece capable of being separated from a base station, which base station contains at least part and possibly all of adjustment system 30, for example. In such embodiments, the handpiece may comprise for example, one or more starting compositions $20_i$ and a dispenser configured to dispense a mixture made from the one or more starting compositions $20_i$. An adjustment member of the packaging and dispenser device may be actuated by the base station as a function of the desired content and/or concentration of active agent in a dispensed preparation.

Various possibilities exist to enable a preparation to be dispensed with the desired contents and/or concentrations of active agent. For example, system 10 may comprise a packaging and dispenser device having two or more reservoirs 21 and 22 containing different starting compositions $20_i$, for example with the first reservoir 21 containing a neutral composition and the second reservoir 22 containing an active agent. The term "neutral composition" should be understood as a composition configured for use alone and/or for mixing with at least one other composition containing a primary or secondary active agent in order to make a preparation for dispensing. Further, one of skill in the art will understand that while 2 reservoirs, 21 and 22, are discussed herein, any number of reservoirs may be implemented, for example, 3, 4, 5, or more reservoirs as desired.

In some embodiments, the proportion of active agent in a dispensed preparation may be adjusted by modifying head loss in feed ducts 39 connecting the reservoirs 21 and 22 containing the starting compositions $20_i$ to one or more corresponding dispenser orifices 35.

Figure 10:
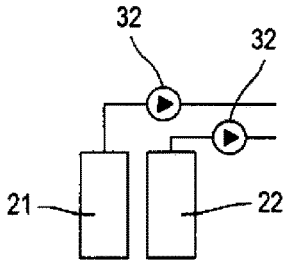
FIGS. 10 to 14 are exemplary diagrams showing various methods of dispensing a preparation having the desired properties according to embodiments of the present disclosure.

FIG. 10 shows an exemplary configuration according to embodiments of the present disclosure, wherein reservoirs 21 and 22 are associated with adjustable-rate pumps 32. In such embodiments, for example, the adjustable rate pumps may be operated at various flow rates to cause a desired preparation to be produced.

Figure 11:
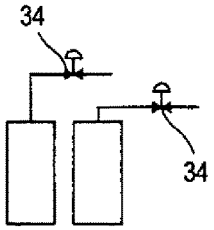

FIG. 11 shows another exemplary configuration according to embodiments of the present disclosure, wherein reservoirs 21 and 22 containing the starting compositions $20_i$ may be associated with valves 34. Valves 34 may enable a flow rate for each feed duct 39 to outlets 35 to be adjusted.

Figure 24:
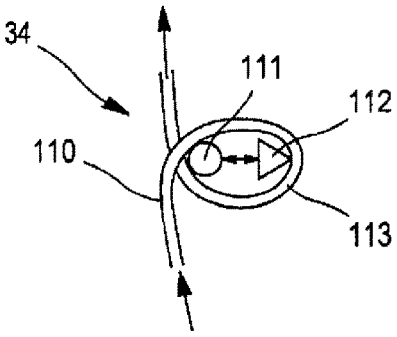
FIG. 24 shows one exemplary arrangement for adjusting flow rate according to embodiments of the present disclosure.

In some embodiments, for example, as shown in FIG. 24, it may be possible to provide a device for pinching an elastic or semi-elastic feed duct 110 through which one of the starting compositions $20_i$ travels. For example, duct 110 circumscribes a loop 113 that bears against a support 111 of the device. A movable spacer element 112, which is controlled by a system 10, is capable of moving relative to support 111 to cause duct 110 to flatten or expand. In some embodiments, spacing of movable element 112 may be controlled by a motor (not shown). In some embodiments, element 112 may be triangular in shape and a spring (not shown) may urge it against duct 110 in the absence of power being applied to the motor. When the motor is powered, element 112 is moved towards the support 110, and the duct returns elastically to a bore of greater inside section. In some embodiments, the motor used may be a stepper motor, e.g. of the Performax type, and by way of example the duct may be a flexible plastics tube having a diameter of 3 millimeters (mm) and a length of 55 mm.

Figure 12:
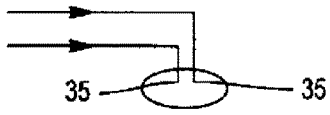
Figure 13:
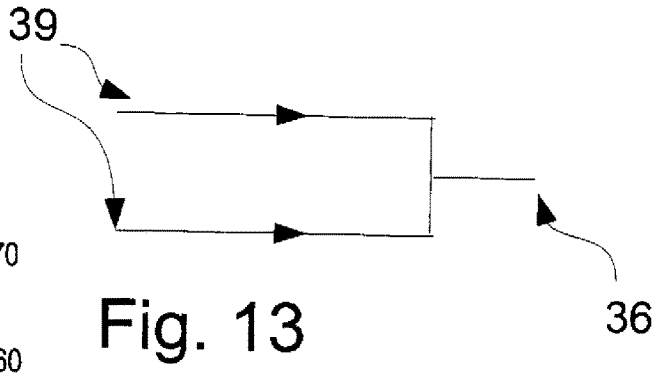

Feed ducts connected to reservoirs 21 and 22 may deliver starting compositions $20_i$ via two separate dispenser orifices 35, as shown in FIG. 12, or they may be in fluid communication, resulting in delivery to the outside via a single dispenser orifice 36, as shown in FIG. 13.

The proportions of the various starting compositions $20_i$ may also be adjusted by obtaining a greater or smaller actuating strokes in pumps. Such actuation may be performed by the user for the purpose of dispensing the preparation, and each stroke may be associated with respective different starting compositions $20_i$.

For example, pumps according to some embodiments of the present disclosure may have control rods for pushing in, and one of the rods may be actuated over a constant stroke to dispense a neutral composition from one of the reservoirs 21 and 22. Further another rod may be actuated over a variable stroke to dispense an active agent from another reservoir, the active agent being mixed with the neutral composition. The variable stroke may be obtained, for example, by a transmission element under the control of a motor. Dispensing may also be performed by acting on one or more pistons associated with reservoir 21 and 22, by moving the pistons over greater or smaller strokes.

Figure 16:
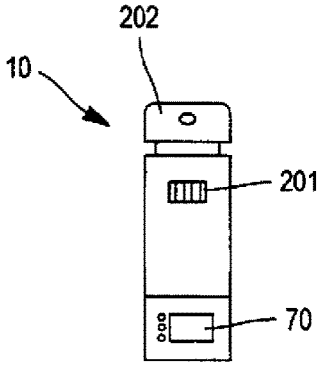

FIG. 16 shows an exemplary configuration according to some embodiments of the present disclosure, wherein system 10 includes a display 70 suitable for displaying a recommendation for adjustment as a function of the received data and possibly as a function of data coming from various sensors and/or user preferences.

System 10 may include a manual adjustment member 201 enabling the concentration of active agent to be adjusted in the preparation that is dispensed. In such embodiments, operation of the device is semiautomatic. The user may actuate the adjustment member as a function of the displayed recommendations. Where desired, display 70 may form part of a base block that is separable from a composition block containing reservoirs 21 and 22, to enable the base block to be used with other compositions.

Figure 17:
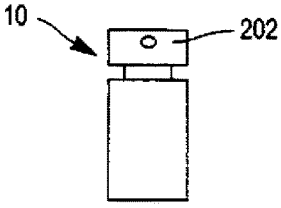

FIG. 17 shows another exemplary configuration according to embodiments of the present disclosure, where system 10 supports a dispenser head 202 that may be actuated by the user in order to dispense the preparation.

Figure 18:
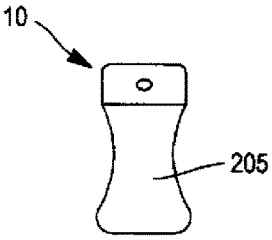

As shown in FIG. 18, the preparation may also be dispensed by providing the packaging and dispenser device of system 10 with a body having a deformable wall 205, e.g., enabling the inside volume of the reservoir(s) containing the starting composition(s) to be reduced.

In embodiments consistent with FIGS. 17 and 18, the properties of the preparation are adjusted automatically as a function of information received by system 10.

Figure 19:
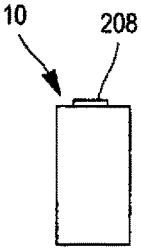

FIG. 19 shows an exemplary embodiment of system 10 providing energy desired for dispensing independent of the user. For example, system 10 may include a trigger button 208 on which the user may press in order to trigger automatic dispensing of the preparation, e.g. by actuating a pump.

Figure 20:
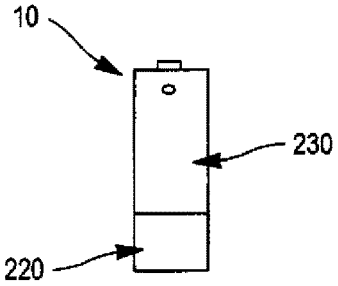

FIG. 20 shows another exemplary configuration consistent with embodiments of the present disclosure, wherein system 10 may have a base station 220 that includes electronic circuits, and in particular data receiver 50, optionally user interface 40, and all or part of adjustment system 30.

Figure 21:
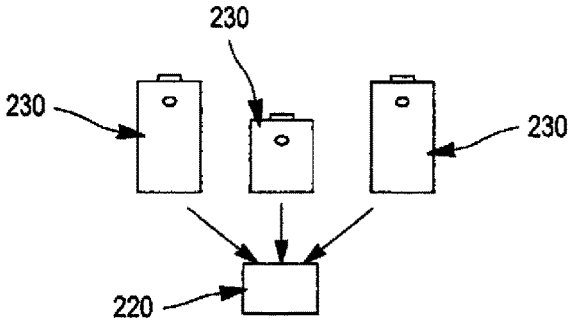

Base station 220 may be fitted on the packaging and dispenser device that includes reservoirs 21 and 22 of starting compositions $20_i$, the dispenser means, and all or part of the adjustment system 30, where desired.

Where desired, for example, as shown in FIG. 21, it may be possible for a common base station 220 to be associated with a plurality of packaging and dispenser devices 230, e.g. containing different compositions, e.g. one device for dispensing a preparation to provide sunscreen, one device to dispense a preparation for providing protection against the cold, etc.

Base station 220 may be configured to recognize automatically the starting compositions $20_i$ contained in reservoirs 21 and 22 of the packaging and dispenser device 230 with which it is coupled, so as to take account of the starting compositions $20_i$ in the adjustment performed. By way of example, this recognition may take place by means of electrical contacts, an electronic chip, e.g. a radio frequency identity (RFID) chip, a mechanical feeler, and/or an optical reader, among others.

Figure 22:
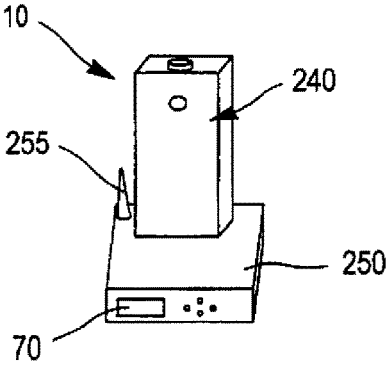

FIG. 22 shows the possibility of system 10 being in two portions, namely with a packaging and dispenser device in the form of a handpiece 240, e.g. containing the various starting compositions $\mathbf{20}_i$ and the dispenser means, and a base station 250 capable of being separated from device 240 and containing, for example, user interface 40, display 70, and an optional data-reception antenna 255.

Where desired, the base station may serve as a docking station for a mobile telephone such as, for example, an iPhone®, or the like, that can act as a user interface, that can serve to receive data, and that can perform in the role of processor means 31 with or without desired software.

Where desired, the packaging and dispenser device may not include electrical adjustment actuators. Actuators may be present solely in the base station, and the actuator may cooperate by mechanical transmission with an adjustment member present in the packaging and dispenser device, e.g. a valve for adjusting flow rate, or a selector.

System 10 may be miniaturized, portable and hand held. Alternatively, system 10 may not be miniaturized and may be of such size as to form a bulkier station, e.g. for placing on a counter or on a shelf in the bathroom. Such a system may comprise a housing 260 suitable for releasably receiving containers 261 containing the various starting compositions $\mathbf{20}_i$ that can be mixed together, together with one or more ducts 265 for dispensing one or more preparations of properties that are adapted to the conditions of the surroundings as a result of the system receiving data.

Where desired, the compositions may be dispensed without being mixed, by selecting which composition is to be delivered to a composition dispensing orifice. It may be desired to mix a plurality of starting compositions $\mathbf{20}_i$. For example, system 10 may contain a plurality of compositions in separate containers (two or more) and depending on the information received it may determine to deliver only one of the compositions.

Figure 14:
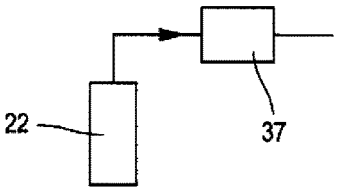

The properties of the preparation that is dispensed may also be adjusted by exerting action on a starting composition containing a compound that is suitable for being released to a greater or lesser extent or for responding to a greater or lesser extent to a stimulus that is applied to the composition. In such embodiments, the starting composition may be contained, for example, in a single container 23 and is taken to a treatment chamber 37 where a stimulus is applied to confer the expected property to the composition, for example, as shown in FIG. 14.

Figure 25:
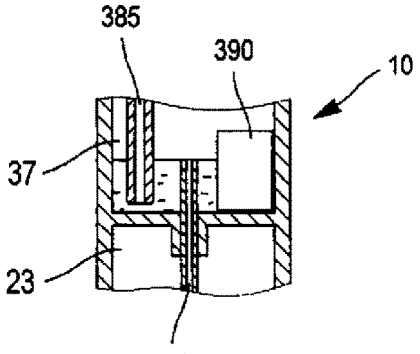
FIG. 25 is an exemplary diagrammatic section of one embodiment of the present disclosure enabling a predefined quantity of a substance to be treated in order to activate an active agent and produce a preparation with desired properties.

FIG. 25 is a diagram showing a portion of an exemplary system 10, in which a composition contained in a reservoir 23 may be dispensed in a predefined quantity into a treatment chamber 37. In some embodiments, this dispensing may be performed via a dip tube 382 that projects into the bottom of the chamber 37 and that enables surplus composition to be returned down to the reservoir 23. The composition may be pumped into the chamber 37 by composition-taking means 385, e.g. a pump, means for pressurizing the space above the composition in the chamber, or by turning the device upside-down. A system 390 serves to expose the composition contained in the chamber to a stimulus in a controlled manner so as to modify its properties. For example, the chamber may contain a heater resistance element or UV lighting system, for the purpose of releasing an active agent held captive in a thermo fusible compound, or to release an active agent previously deactivated by a photolabile function.

Figure 26:
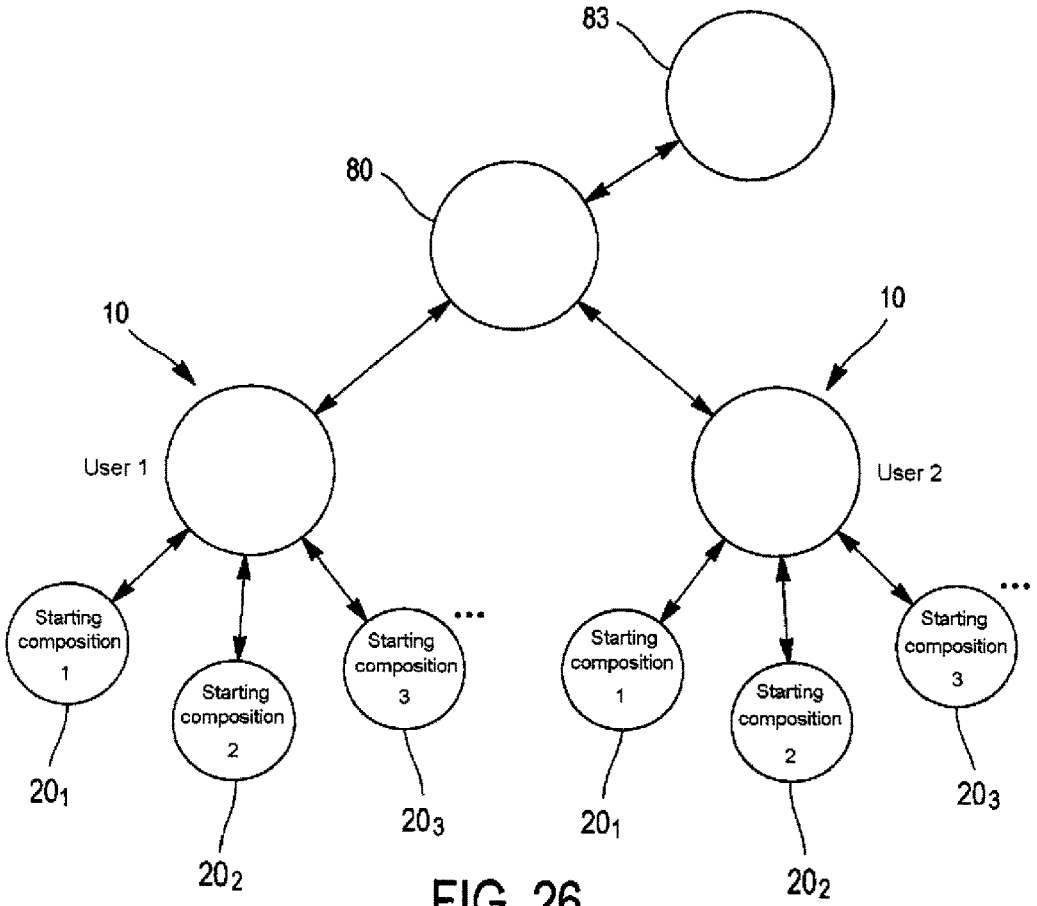
FIG. 26 is an illustration of an exemplary network array for transmitting data to a plurality of systems according to embodiments of the disclosure.

FIG. 26 shows an exemplary configuration consistent with embodiments of the present disclosure, wherein a plurality of systems 10 of the disclosure that may receive data from a remote server 80, which may itself receive information from a weather forecast server 83, for example. Systems 10 may receive information associated with the starting compositions $\mathbf{20}_i$ from which the preparation dispensed by each of the plurality of systems 10 is prepared. In accordance with the embodiments of the present disclosure, each system 10 may receive data relating to present or future conditions of the surroundings, for a given location of system 10.

Figure 28:
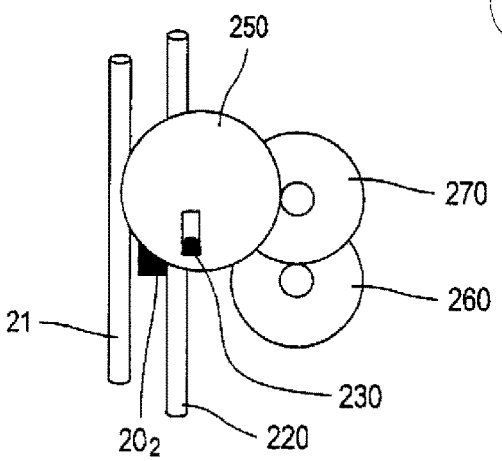
FIGS. 28 and 29 show other arrangements of the adjustment system.

In some embodiments, e.g., as shown in FIG. 28, the packaging and dispenser device has two reservoirs containing the starting compositions $\mathbf{20}_i$ and connected to two outlet ducts 210 and 220, e.g. two flexible tubes of plastics material having a diameter of 3 mm and a length of 25 mm. One of the ducts 210 may be permanently open while the other duct 220 may be closed to a variable extent by a pinch valve, e.g. including a wire 230, as shown in FIG. 28, e.g. a piano wire having a section of 1 mm and a length of 3 centimeters (cm). Wire 230 is positioned in prestressed manner so as to flatten the duct against a rigid stationary part 240 of the device, e.g. a part that also supports the other duct 210. The natural elasticity of wire 230 is sufficient to pinch the duct 220 at rest so as to prevent the composition from passing therethrough, particularly when the user presses on the corresponding reservoir.

In such embodiments, the other end of wire 230 may be engaged in a small toothed wheel 250 having a slot. Wheel 250 is driven by a motor 260, e.g., a direct current (DC) motor, and a gear train 270 configured to increase a torque delivered by motor 260 in proportion to the electrical current.

When motor 260 is powered, it transmits its torque to the wheel 250, which pulls on wire 230 and moves it away from stationary part 240. The higher the current delivered to motor 260, the less wire 230 flattens the duct 220, thereby enabling more composition to pass if the user presses on the second reservoir. When motor 260 is no longer powered, the elasticity of wire 230 returns it to press again against duct 220, which it flattens against the stationary part 240.

The energy needed to deliver the starting compositions $\mathbf{20}_i$ may be provided, for example, by the user pressing on two flexible reservoirs. Thus, in such embodiments, no liquid leaves the reservoirs or passes along the outlet ducts unless the user presses on the reservoir.

Figure 29:
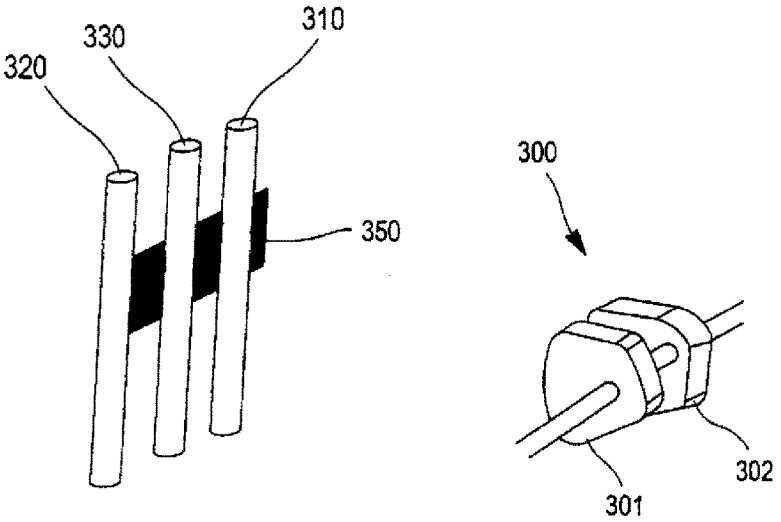

In some embodiments, for example, as shown in FIG. 29, the packaging and dispenser device may have three flexible-walled reservoirs, containing respective starting compositions $\mathbf{20}_i$. Each flexible-walled reservoir is provided with a delivery duct, all three of the these ducts 310, 320, and 330 opening out, for example, at a spacing of 4 mm from one another. Thus, when the three starting compositions $\mathbf{20}_i$ are delivered, the user receives a mixture made by the three compositions coming into contact.

In some embodiments, each duct may be formed by a flexible plastic tube having a diameter of 3 mm and a length of 25 mm. The ducts 320 and 330 associated respectively with the second and third reservoirs may be held by a rigid part 350 of the device that is stationary relative to the reservoir, as shown in FIG. 29.

In such embodiments, the device may include a pair 300 of cams, in which the two cams 301 and 302 are offset and located in front of the ducts 320 and 330. In the rest position, the two cams 301 and 302 compress the two ducts 320 and 330. When the shaft carrying the cam pair 300 turns, the first cam 301 releases the corresponding duct 320. Thereafter, if the shaft of the cam pair continues to turn, the second cam releases the other duct.

In such embodiments, the energy for delivering the compositions may also be provided by the user delivering pressure by compressing the two flexible reservoirs. Thus, no composition leaves the reservoirs and passes along the ducts unless the user squeezes the reservoirs.

FIG. 31 shows another exemplary configuration according to some embodiments of the present disclosure. System 10 may include two compartments (e.g., flexible container) in which starting compositions $\mathbf{20}_i$ may be stored. System 10 may further include a closure cap, on or more surroundings sensors (e.g., UV sensor), a trigger/measure button, and servo motors.

In such a configuration, closure cap may be configured to be affixed to system 10, so as to close system 10, and/or packaging and dispensing device, substantially or completely from the air, for example to prevent drying or damage. Closure cap may be of any suitable variety, for example, screw on, snap on, hinged, etc.

Further, surroundings sensors 61 may be located on system 10 and/or packaging and dispensing device, such that upon affixing closure cap to system 10 and or packaging and dispensing device, surrounding sensors 61 may be substantially protected from damage and/or exposure to unwanted substances (e.g., finger smudges).

Trigger/measure button may be of any variety switch and may further be implemented as a tactile element on display 70, as desired. Trigger/measure button may enable functioning of system 10 (e.g., take measurements, receive data, dispense desired preparation, etc.) upon user actuation.

Servo motors may be linked to processor means 31 to enable processor means 31 to provide control to servo motors. Servo motors may further be configured to enable taking up starting composition from the compartments. Therefore, servo motors, and/or pumps associated therewith, may be in optional fluid communication with the internal sections of the compartments. Upon actuation of servo motors, starting composition may be drawn from one or more of the compartments, proportional to the operation of the respective servo motor.

Example 1

Figure 30:
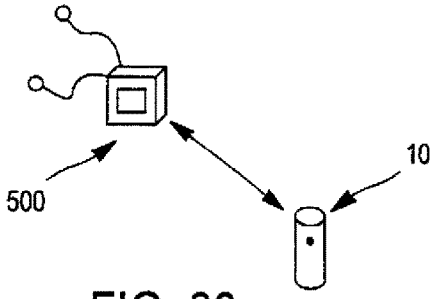
FIG. 30 is an illustration of shows additional ways data may be received by the system according to exemplary embodiments of the disclosure.

In this example, the system receives data from a home weather station 500, as shown in FIG. 30, and desires to dispense a care product.

Figure 27:
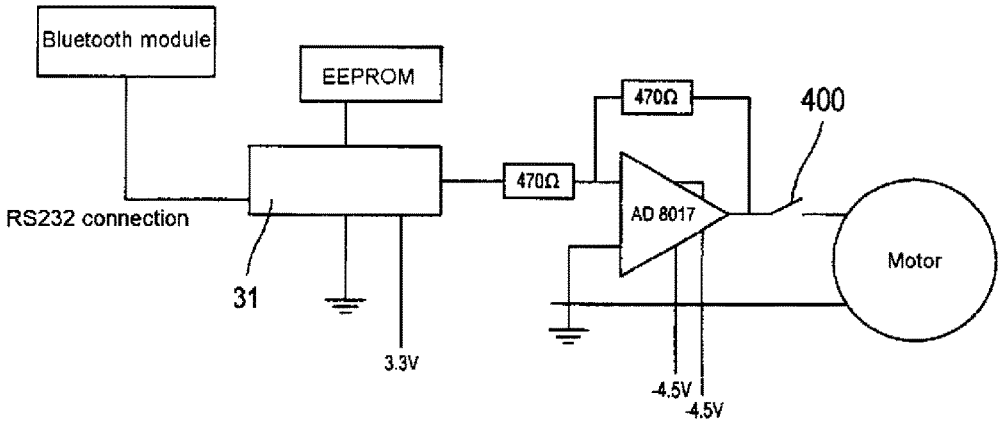
FIG. 27 is a schematic of an example of an electronic circuit suitable for being incorporated in a system according to exemplary embodiments of the disclosure.

An electronic circuit is provided as shown in FIG. 27 that comprises a receiver, e.g. constituted by a Bluetooth™ receiver module, carrying an antenna and an RS232 universal asynchronous receiver/transmitter (UART) component, processor means 31 including a microcontroller including a digital-to-analog converter, a 48 kilobyte (KB) electrically-erasable programmable read-only memory (EEPROM), and an amplifier module including an AD 8017 power amplifier in a negative feedback configuration and powering a motor. A trigger button 400 is mounted at the output from the power amplifier.

By way of example, the adjustment system is that described with reference to FIG. 28, the motor being controlled by a voltage U. By way of example, the microcontroller has a program stored in the EEPROM serving to convert RS232 digital signals into a voltage analog output for activating the motor via the power module.

The electronic circuit with the above-described components may be adhesively bonded to the top of the device, for example, together with the trigger button that is presented on top. A protective cap may cover the top of the packaging and dispenser device, so as to avoid dirtying.

The home weather station may be a PTU 200 weather station manufactured by the supplier Vaisala, having a humidity sensor, a pressure sensor, and a temperature sensor that may be located outdoors (balcony, garden, . . . ), or indoors. If located indoors, the temperature and humidity sensors may be located remotely therefrom. The digital output from the weather station is connected to a Bluetooth™ transmitter module. The weather station is programmed to send the temperature, pressure, and humidity at regular intervals, e.g. once per minute.

The packaging and dispenser device has two reservoirs containing the starting compositions $\mathbf{20}_i$. In the present example, the first reservoir is filled with an emulsion containing 30% glycerin and the second reservoir is filled emulsion containing 10% talc, with neutral components making up the remainder to 100%.

The program of the microcontroller may be designed, for example, to extract the temperature data from the data received by the Bluetooth™ module. The temperature data T (expressed in ° C.) is processed for example using the following function:

$$U=K(T+10) \text{ with } K=0.1$$

and $$U=0 \text{ if } T<-10^\circ \text{ C.}$$

U being the voltage delivered to the motor.

To deliver the preparation, the user squeezes the flexible reservoirs while pressing with a finger on the trigger button.

A preparation, characteristics of which may be varied, is then dispensed based on the sensed outside temperature. For example, concentrations in the mixture of the two starting compositions $\mathbf{20}_i$ may be relatively high in glycerin and relatively low in talc if the outside temperature is relatively low, or relatively low in glycerin and relatively high in talc if the temperature is relatively high. High and low temperatures being defined generally based on an area in which the device is located. For example, low temperatures may mean below freezing (0 degrees C.) while high temperatures may mean above about 25 degrees C.

System 10 may adapt directly to current conditions of the surroundings, to improve and/or optimize comfort and the effect on the skin.

The following day, the user may use the same system. If the temperature is different, then the mixture delivered by the system may change accordingly.

Example 2

In this example, the first reservoir is filled with an emulsion containing 30% glycerin, and 2% sun filter, and the second reservoir is filled with an emulsion containing 20% sun filter, the remainder to 100% being made up by neutral materials.

The program of the microcontroller is designed to extract the temperature and pressure data from the data received by the Bluetooth™ module and to process the temperature and pressure data T and P (expressed in bars) on the basis of the following function:

$$U=0.1(T+10)+20(1-P)$$

and $$U=0 \text{ if } 0.1T-10P<-21$$

Depending on the sensed outside temperature and pressure, characteristics of the dispensed preparation may change, e.g., the mixture of the two liquids may vary in glycerin and sun filter.

If the pressure is low (e.g., 0.9 bar or below) and the temperature is moderate (e.g., about 20° C.), the mixture is relatively rich in sun filter because the user is likely to encounter strong sunlight, which may be particularly dangerous because of high altitude. Therefore, it is desirable to protect the user against UV radiation.

If the pressure is low (e.g., 0.9 bar or below) and the temperature is low (e.g., −20° C.), the mixture is rich in glycerin and contains relatively low amounts of sun filter, because the user is likely at altitude and protected by a mass of clouds and/or in low sunlight conditions as a result of being early or late in the day. It may thus be desirable to provide the user with protection against the cold, while also providing a small amount of sun filter.

If the pressure is normal (e.g., around 1 bar) and the temperature is moderate (e.g., about 20° C.), the mixture is intermediately mixed between the glycerin and the sun filter. This may be because it is likely that sunlight is moderate given the low altitude and a temperature that is reasonable for low altitude.

If the pressure is normal (e.g., around 1 bar) and the temperature is low (e.g, −20° C.), then the mixture is rich in glycerin. It is desirable to provide protection against the cold.

If the pressure is normal (e.g., around 1 bar) and the temperature is high (e.g., 40° C.), then the mixture is relatively high in sun filter. Under such conditions, the user is likely subjected to a large amount of sunlight. The following day, the user may use the same system. If conditions have changed, the mixture delivered by the system may change accordingly.

Example 3

In this example, the first reservoir is filled with a microemulsion of a nourishing agent (e.g., hydrocarbon oil) and the second reservoir with an emulsion containing a moisturizing agent (e.g., glycerin.)

The program of the microcontroller is designed to extract the temperature and humidity data from the data received by the Bluetooth™ module and to recalculate the humidity data on the basis of the following function:

RH=measured relative humidity, with a ceiling of 60% in other words, if the measured humidity >60%, then RH=60.

The temperature and humidity data T and RH (expressed in units in the range 0 to 60) is processed on the basis of the following function:

$$U=0.1(T)+0.1(40-RH)+1$$

If the value of U is negative, then U is set at 0, and if the value of U is greater than 5, then U is set at 5.

If the temperature is high (e.g., 30° C. or higher) and the relative humidity is high (e.g., 60% or more), then the mixture is rich in nourishing agent.

If the temperature is high (e.g., 30° C. or higher) and the relative humidity is low (e.g., 20% or less), then the mixture is rich in moisturizing agent.

If the temperature is low (e.g., 0° C. or less) and the relative humidity is high (e.g., 60% or more), then the mixture is rich in nourishing agent.

If the temperature is low (e.g., 0° C. or less) and the relative humidity is moderate (e.g., about 20%), then the mixture is intermediate, containing relatively similar concentrations of both nourishing agent and moisturizing agent.

Example 4

In this example, the system receives data from a remote server.

By way of example, the server is based on AMD Opteron® processors, but any suitable server processor configuration may be suitable. The server is configured to establish a multitude of connections with individual terminals.

The remote server is also connected to the Internet and provided with software enabling it to act via client-server or other suitable connections with established meteorological servers on the web to collect information by geographical region, e.g. concerning temperature, sunlight, pollution, wind, both present and forecast, e.g. for the day.

The remote server may sort this information and interpolate missing data, for example, placing it in a table T.

The server may receive connection requests from the devices over the Internet.

In this example, the system comprises a base station in the form of an individual terminal, having a rechargeable power supply, e.g. an embedded PC of the PC 104 type, together with an operating system and a small touch screen.

By way of example, the individual terminal is fitted with an RJ45 wired Internet communications module, and a WiFi module and/or a Bluetooth™ module enabling it to communicate with one or more systems according to exemplary embodiments of the disclosure.

The individual terminal may be provided with software for reading data input by the user via the touch screen, e.g. the geographical location of the user (region and altitude), personal data concerning the user, e.g. hair length, hair color, hair state, skin type, tanning, type of activity, in particular working outdoors, working indoors, holidays/vacations.

The individual terminal may store this data in its memory, thus enabling the user to modify the data, and it may regularly make a connection with the remote server. The Internet address of the remote server may be recorded in the memory of the individual terminal so that the connection is established automatically.

The individual terminal may be arranged to download from the remote server a fraction of the table T that contains present and forecast meteorological data corresponding to the user's region.

The individual terminal may also be arranged to modify the meteorological data with an altitude factor, or for example to lower temperatures by 1° C. for every 100 meters (m) of altitude, or to calculate a perceived temperature on the basis of actual temperature and a wind speed chill factor.

The individual terminal may use the Bluetooth™ connection, for example, to make contact with the packaging and dispenser device(s) for dispensing a preparation.

The individual terminal is informed about the nature of the starting composition(s) of the device with which it exchanges information, so it is in a position to determine what mixtures need to be prepared on the basis of the present or forecast meteorological data. The calculation algorithms may differ depending on the preparations.

For a sunscreen, the calculation may be as follows. At the time a connection is made between the individual terminal and the device, the mixture calculation takes account of a level of sunlight E, e.g. on a scale 0 to 10. The level E used is equal to the present level of sunlight if the connection takes place between noon and 3:00 PM. It is equal to 50% of the present level if the connection takes place between 4:00 PM and 5:00 PM. It is equal to 25% of the present level if the connection takes place after 5:00 PM. It is equal to the forecast level if the connection takes place before noon.

The mixing ratio M is equal to the level of sunlight E multiplied by a factor S that takes account of the month, e.g., S=0.25 for months in the range November to March, S=0.5 in the months April, May, and October, and S=1 for the months of June, July, August, and September. The result is then multiplied by a factor A that depends on altitude, with A=0.5 below 1000 m, A=0.75 in the range 1000 m to 2000 m, and A=1 above 2000 m.

The information relating to the mixing ratio M is delivered to the device for dispensing the sunscreen preparation that may be of the same kind as described in Example 1.

In exemplary embodiments, when the protective cap is removed, the device containing the starting compositions $\mathbf{20}_i$ sends a connection request to the individual terminal. The terminal identifies the starting compositions $\mathbf{20}_i$ e.g. on the basis of an identifier of the device and/or of the starting compositions $\mathbf{20}_i$.

By way of example, for a sunscreen preparation, the two reservoirs may contain respectively an emulsion without sun filter and an emulsion containing 20% sun filter.

The microcontroller of the device is programmed to convert the information relating to the mixing ratio M into a voltage that is proportional to M, lying in the range 0 to 5 V, which voltage is used to control the motor of the adjustment system.

Thus, in use, when the device is connected to the individual terminal, and the user squeezes the reservoirs, characteristics of the dispensed preparation may be varied, e.g., to create a mixture that is rich to a greater or lesser extent in sun filter. The quantity of filter is improved and/or optimized to provide desired protection against the sun.

Other Examples

In a similar manner, systems may be provided that contain compositions for protecting the skin, the hair, antiperspirants, and hair control compositions, among others.

The calculation may take into account not only data concerning the surroundings, but also individual data in order to optimize the mixtures, e.g. when making calculations concerning hair care, account may be taken of the length and the type of the hair, when making calculations concerning hair protection, account may be taken of the color of its tinting, when performing calculations concerning skin care, account may be taken of a person's age, when performing calculations concerning protection against the sun, account may be taken of a person's age and skin color, and when performing calculations for an antiperspirant, account may be taken of the user's activity and/or current level of perspiration.

The disclosure is not limited to the examples described above, and the implementation features thereof may be combined with one another in variants that are not shown without departing from the scope of the present disclosure. For example, it may optionally be possible to override the system in order to reproduce a mixture from a stored (e.g., previously programmed and saved) formula or a mixture as desired by the user.

The system may be arranged to warn the user of the need to reapply the preparation or to review the mixture, e.g. if the system detects that conditions have changed and/or where a clock indicates a determined amount of time has passed.

Throughout the description, including the claims, the term "comprising a" should be understood as being synonymous with "comprising at least one" unless otherwise stated. In addition, any range set forth in the description, including the claims should be understood as including its end value(s) unless otherwise stated.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A cosmetic or dermatological system comprising:

a common base station;

a receiver of data included in the common base station, the receiver of data related to current/future surrounding conditions, said data being received from a data transmitter external to the system and comprising information related to at least one of an intensity of UV radiation, a temperature, a humidity, wind, precipitation, pollution, and a pressure;

a plurality of packaging and dispenser devices being associated with the common base station and receiving the data from the base station, each of the plurality of packaging and dispenser devices containing one or more compositions from which a preparation is delivered, each of the plurality of packaging and dispenser devices being in the form of a handpiece capable of being separated from the base station for dispensing the preparation;

a plurality of adjustment systems, each being coupled to or configured for coupling to one of the plurality of packaging and dispenser devices, and that enables at least one characteristic of the preparation delivered by the packaging and dispenser device to be modified; and a processor configured to automatically control the adjustment systems as a function of the received data or for informing a user, as a function of the received data, about an action to be exerted on the adjustment systems, wherein at least one of the plurality of packaging and dispenser devices dispenses a preparation selected from preparations to provide sunscreen, preparations for providing protection against the cold, preparations to aid in moisturizing the skin, an antiperspirant, a deodorant, a fragrance, preparations for providing protection against mosquitoes, care preparations, preparations for washing the body and the hair, makeup and hair-shaping preparations, the preparation being different from a second preparation dispensed by a second device of the plurality of packaging and dispenser devices, the second preparation being selected from preparations to provide sunscreen, preparations for providing protection against the cold, preparations to aid in moisturizing the skin, an antiperspirant, a deodorant, a fragrance, preparations for providing protection against mosquitoes, care preparations, preparations for washing the body and the hair, makeup and hair-shaping preparations.

2. The system according to claim 1, wherein each packaging and dispenser device comprises a first reservoir and second reservoir, the first reservoir containing a first composition and the second reservoir containing a second composition, the adjustment system enabling the first and second compositions to be dispensed in a determined proportion as a function of the received data.

3. The system according to claim 1, wherein each packaging and dispenser device comprises a first reservoir and a second reservoir, the first reservoir containing a first composition and the second reservoir containing a second composition, the adjustment system enabling a selected one of the first or second compositions to be dispensed.

4. The system according to claim 2, wherein the first composition has a first concentration of at least one active agent that differs from a second concentration of the at least one same active agent in the second composition.

5. The system according to claim 4, wherein the at least one active agent is selected from the group consisting of a sun protection filter, an antistatic agent, an anti-insect agent, a moisturizer, a fragrance, a deodorant, and an antiperspirant.

6. The system according to claim 1, configured to receive data from an individual terminal.

7. The system according to claim 1, wherein the base station is configured to receive and process information from a remote server in order to generate data for delivery to the packaging and dispenser device.

8. The system according to claim 1, wherein the base station further comprises a user interface enabling input of at least one of a characteristic related to a state of a user's skin, a characteristic related to a state of a user's hair, and information related to an activity of the user.

9. The system according to claim 1, wherein the packaging and dispenser devices are portable.

10. The system according to claim 9, wherein the packaging and dispenser devices are configured to be positioned on the base station when they are not dispensing the preparations.

11. The system according to claim 1, wherein the base station comprises, for each packaging and dispenser device, an actuator suitable for acting on an adjustment member of the packaging and dispenser device while the device is on the base station.

12. The system according to claim 1, wherein the base station is configured to act as a docking station for a mobile telephone suitable for receiving external data and controlling the adjustment systems.

13. The system according to claim 2, wherein the base station is configured to recognize automatically the compositions contained in the reservoirs.

14. The system according to claim 13, wherein the recognition of the compositions is performed by an element selected from the group consisting of electrical contacts, an electronic chip, a mechanical feeler and an optical reader.

15. A method of preparing a cosmetic or dermatological composition using a cosmetic or dermatological system as defined in claim 1, wherein data is delivered to the cosmetic or dermatological system by at least one sender located at a distance from the cosmetic or dermatological system, thereby enabling the adjustment system to be further controlled.

16. The method according to claim 15, wherein the data is delivered by at least one of a home weather station, an individual terminal connected to Internet, and a remote server.

17. The method according to claim 16, wherein the cosmetic or dermatological system is connected to the Internet.

18. The method according to claim 16, wherein the adjustment system is controlled as a function of at least information related to a user to be treated with the preparation.

19. The method according to claim 18, wherein the information related to the user comprises information about a skin type.

20. The method according to claim 16, wherein the adjustment system is controlled as a function of data relating to one or more surrounding forecast conditions.

21. A network, comprising:

a plurality of cosmetic or dermatological systems according to claim 1; and a sending system configured to simultaneously or successively transmit data to the plurality of cosmetic or dermatological systems.

* * * * *